US006984798B1

(12) United States Patent
Lu

(10) Patent No.: US 6,984,798 B1
(45) Date of Patent: Jan. 10, 2006

(54) SAFETY SWITCH

(76) Inventor: Chen Dung Lu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/967,844

(22) Filed: Oct. 19, 2004

(51) Int. Cl.
*H01H 71/16* (2006.01)

(52) U.S. Cl. ..... 200/334; 337/37; 337/66

(58) Field of Classification Search ..... 200/520–525, 200/529–535, 334; 337/36, 37, 56, 62, 66, 337/85, 113
See application file for complete search history.

(56) References Cited

U.S. PATENT DOCUMENTS 5,012,495 A * 4/1991 Munroe et al. ..... 337/66
5,760,672 A * 6/1998 Wang ..... 337/66
6,072,381 A * 6/2000 Yu ..... 337/37
6,674,033 B1 * 1/2004 Wang ..... 200/334

* cited by examiner

*Primary Examiner*—Michael A. Friedhofer

(57) ABSTRACT

A safety switch comprises a hollow body having an opening and a lower end of the hollow body having three slots; a button pivotally installed upon the opening; a first power terminal installed at one of the three slots; a second power terminal installed at another of the three slots; a load terminal installed at the other slot of the three slots; an elastomer being a U shape metal piece; one end of the elastomer being buckled to an upper end of the load terminal and another end thereof being buckled to the press block of the button; and a metal sheet being installed at a lower side of the button; the metal sheet being made of a compound metal having materials of different expansion coefficients; one end of the metal sheet being connected to the a power terminal; and another end thereof being installed with a conductive silver sheet.

6 Claims, 7 Drawing Sheets

SAFETY SWITCH

FIELD OF THE INVENTION

The present invention relates to switches, and particularly to a safety switch, wherein the safety switch has a simple structure and is made of a fewer elements. Thereby the manufacturing process is simplified. The fault rate of the safety switch is reduced.

BACKGROUND OF THE INVENTION

A safety switch is used in electric devices for interrupting the power connection as overloading so as to protect the device to be in safety condition.

Most of the prior art safety switch can achieve the effect of turning off power so as to prevent fire accident. However the structure is complicated, has too many parts, so that a large amount of parts are necessary. Thereby cost is high. All these are main concern in the manufacturing of safety switch.

SUMMARY OF THE INVENTION

Accordingly, the primary object of the present invention is to provide a safety switch, wherein the safety switch has a simple structure and is made by a fewer elements. Thereby the manufacturing process is simplified. The fault rate of the safety switch of the present invention is reduced.

To achieve above objects, the present invention provides a safety switch which comprises the following elements.

A hollow body 10 has an opening at an upper end thereof and a lower end of the hollow body has three slots which are spaced arranged.

A button is pivotally installed upon the opening of the hollow body. A press block downwards extends from a pivotal point of the button.

A first power terminal is installed at one of the three slots.

A second power terminal is installed at another of the three slots.

A load terminal is installed at the other slot of the three slots which is located between the first power terminal and the second power terminal. The load terminal is electrically connected to the second power terminal through a neon bulb and a resistor. An upper side of the load terminal is installed with an electric silver sheet.

An elastomer is a U shape metal piece. One end of the elastomer is buckled to an upper end of the load terminal and another end thereof is buckled to the press block of the button.

A metal sheet is installed at a lower side of the button. The metal sheet is made of a compound metal having materials of different expansion coefficient. One end of the metal sheet is connected to an upper end of a power terminal. Another end thereof is bent to have a U shape structure. A lower side of the U shape structure is installed with a conductive silver sheet corresponding to the electric silver sheet of the load terminal.

In application, the button is pressed to press the metal sheet so that the conductive silver sheet of the metal sheet is electrically connected to the electric silver sheet of the load terminal. Then the press block of the button will move slightly through a small angle so as to compress the elastomer.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
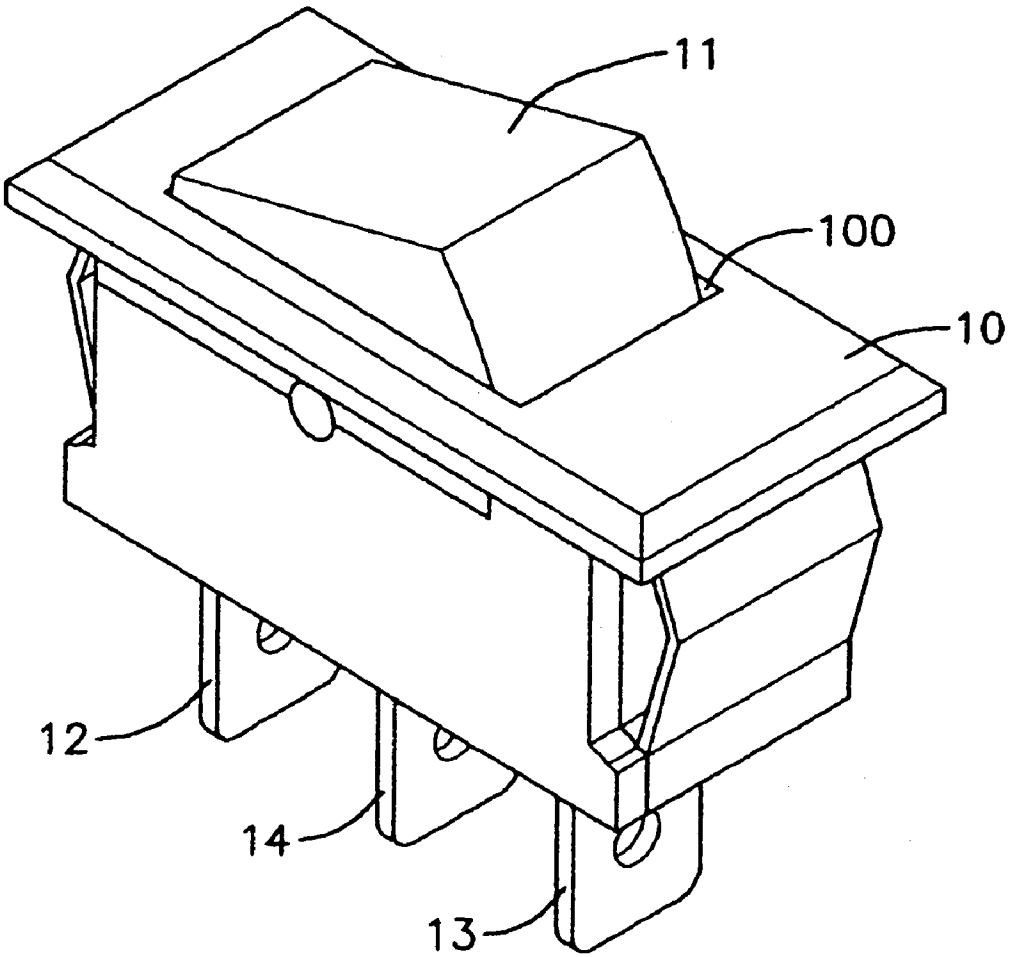
FIG. 1 is a perspective view of the present invention.
Figure 2:
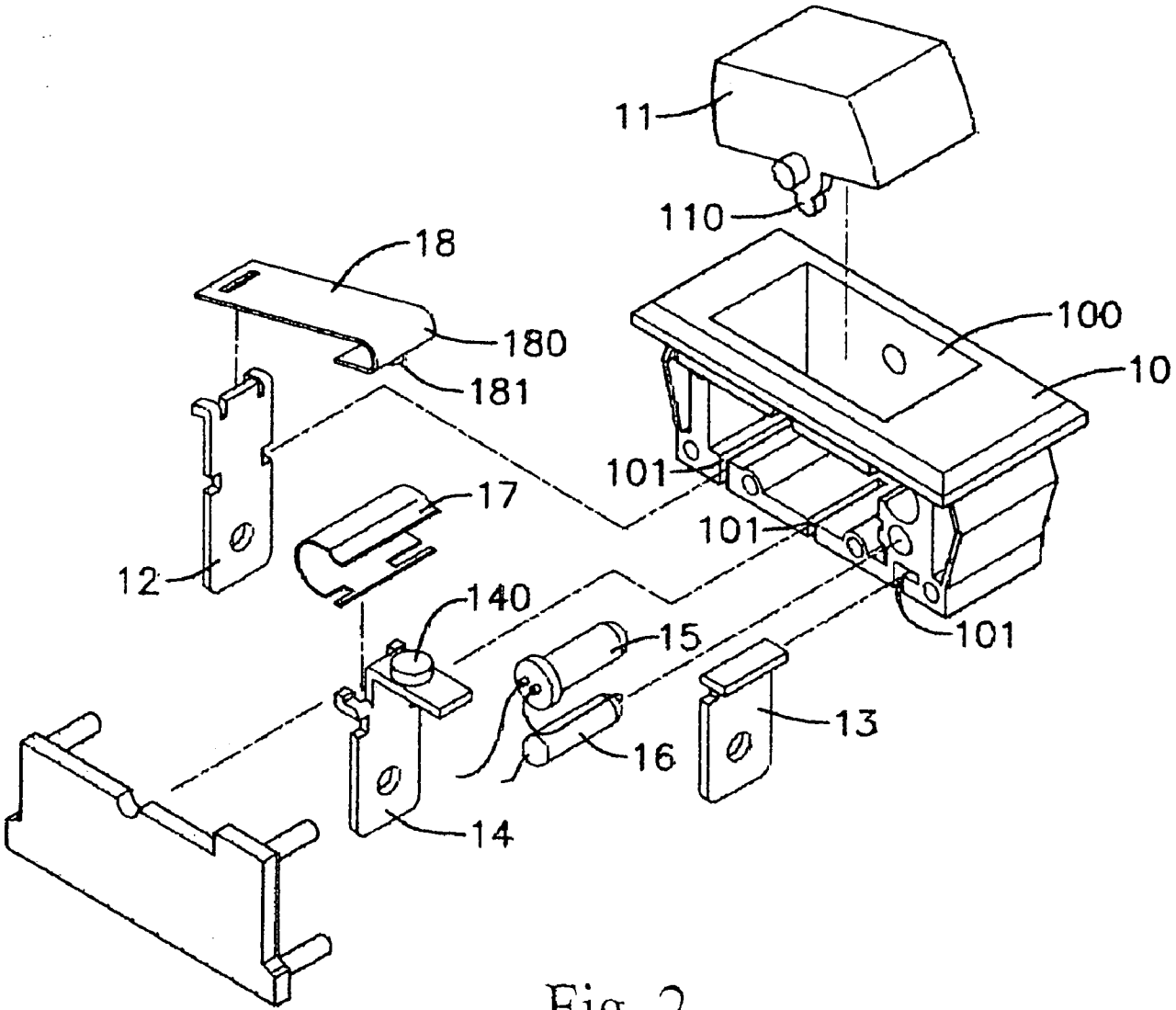
FIG. 2 is an exploded perspective view of the first embodiment.
Figure 3:
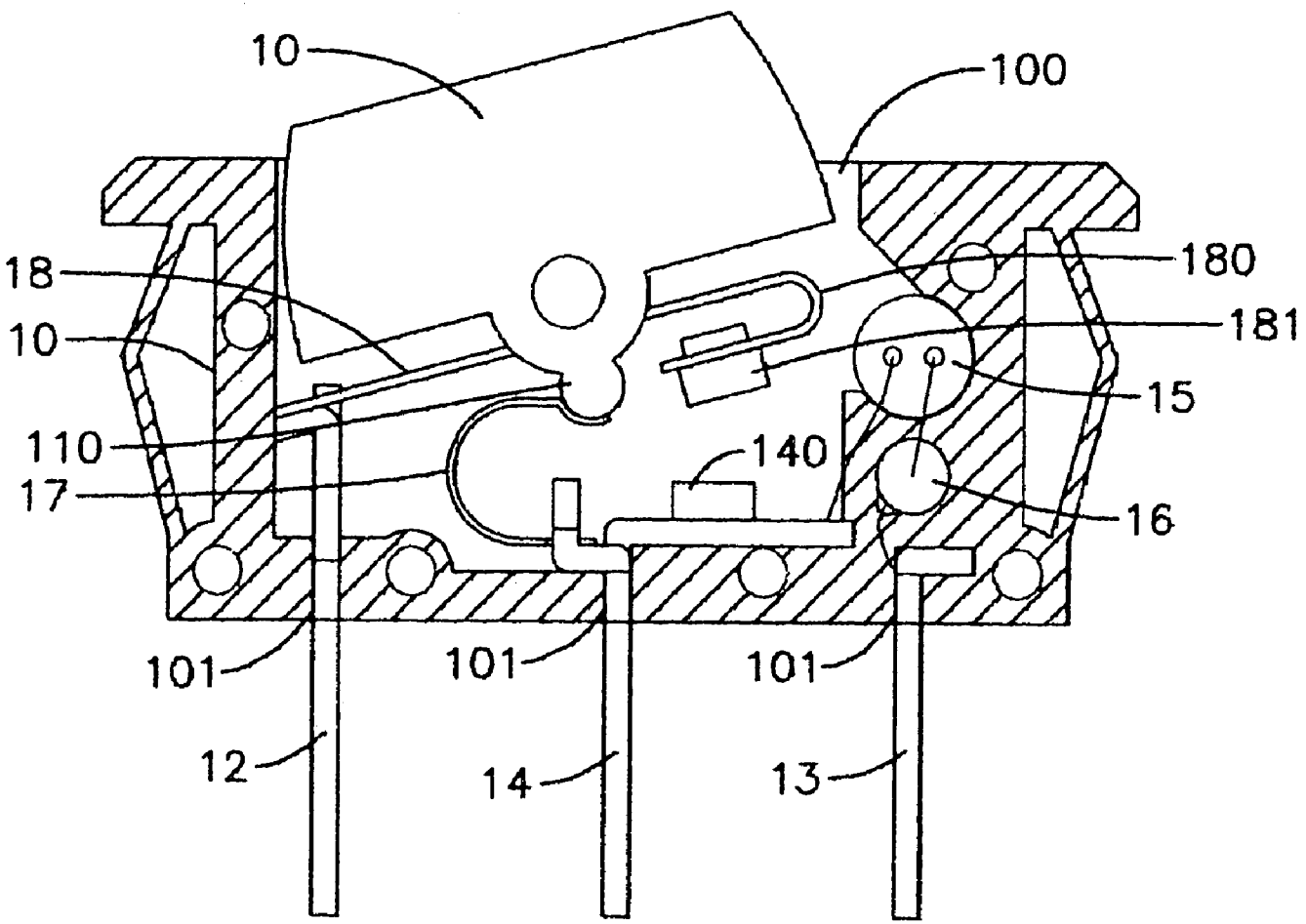
FIG. 3 is a cross sectional view about the first embodiment.

With reference to FIGS. 1 to 3, the first embodiment of the present invention has the following elements.

A hollow body 10 has an opening 100 at an upper end thereof and a lower end of the hollow body 10 has three slots 101 which are spaced arranged.

A button 11 is pivotally installed upon the opening 100 of the hollow body 10. A press block 110 downwards extends from a pivotal point of the button 11.

A first power terminal 12 is installed at one slot of the three slots 101.

A second power terminal 13 is installed at another slot of the three slots 101.

A load terminal 14 is installed at the other slot of the three slots 101 which is located between the first power terminal 12 and the second power terminal 13. The load terminal 14 is electrically connected to the second power terminal 13 through a neon bulb 15 and a resistor 16. An upper side of the load terminal 14 is installed with an electric silver sheet 140.

An elastomer 17 is a U shape metal piece. One end of the elastomer 17 is buckled to an upper end of the load terminal 14 and another end thereof is buckled to the press block 110 of the button 11.

A metal sheet 18 is installed at a lower side of the button 11. The metal sheet 18 is made of a compound metal having materials of different expansion coefficient. One end of the metal sheet 18 is connected to an upper end of a power terminal 12. Another end thereof is bent to have a U shape structure 180. A lower side of the U shape structure 180 is installed with a conductive silver sheet 181 corresponding to the electric silver sheet 140 of the load terminal 14.

Figure 4:
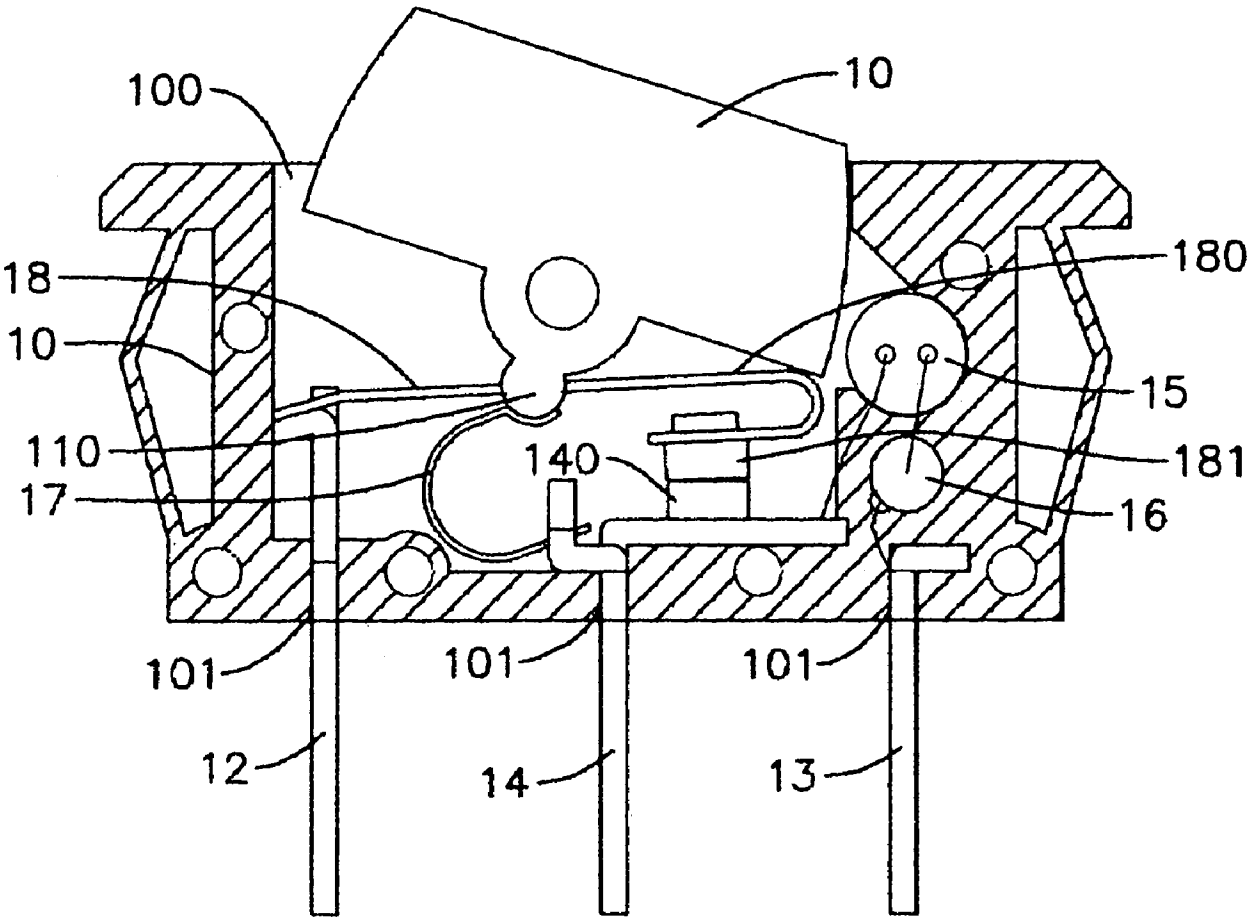
FIG. 4 is a cross sectional view showing the application of the first embodiment of the present invention.

With reference to FIG. 4, in application, the button 11 is pressed to press the metal sheet 18 so that the conductive silver sheet 181 of the metal sheet 18 is electrically connected to the electric silver sheet 140 of the load terminal 14. Then the press block 110 of the button 11 will move slightly through a small angle so as to compress the elastomer 17.

Figure 5:
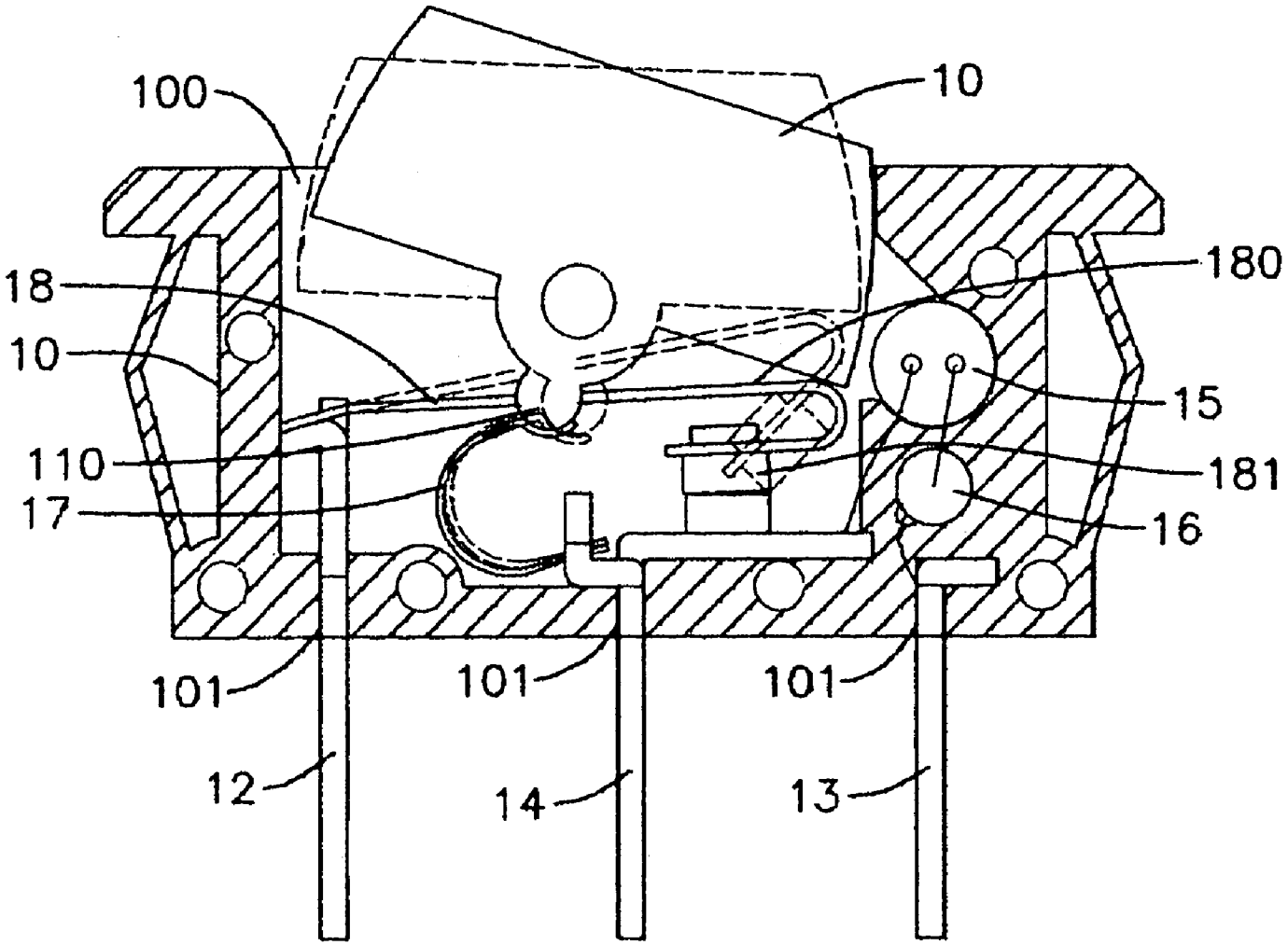
FIG. 5 is a cross sectional view showing the use of the metal sheet in the first embodiment of embodiment.

Referring to FIG. 5, when current overloads, since the metal sheet 18 is made of a compound metal having materials of different expansion coefficient. The U shape structure 180 of the metal sheet 18 will deform so as to expand to make the conductive silver sheet 181 separate from the electric silver sheet 140 so as to lift the button 11 upwards. By the elastic force of the elastomer 17, the press block 110 of the button 11 will be pushed. As a result, the button 11 will lift upwards to turn off the circuit.

When the temperature of the metal sheet 18 is not reduced, the U shape structure 180 will not restore to the original shape. At this moment, if the button 11 is pressed again, the conductive silver sheet 181 will not electrically connected to the electric silver sheet 140. Thereby the circuit is in safety condition.

Figure 6:
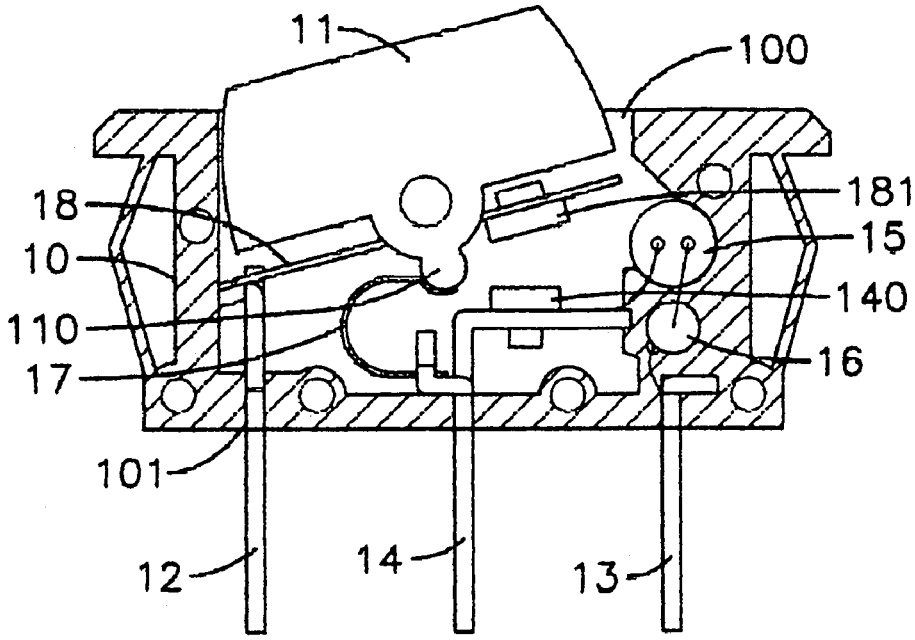
FIG. 6 is a cross sectional view of the second embodiment of the present invention.
Figure 7:
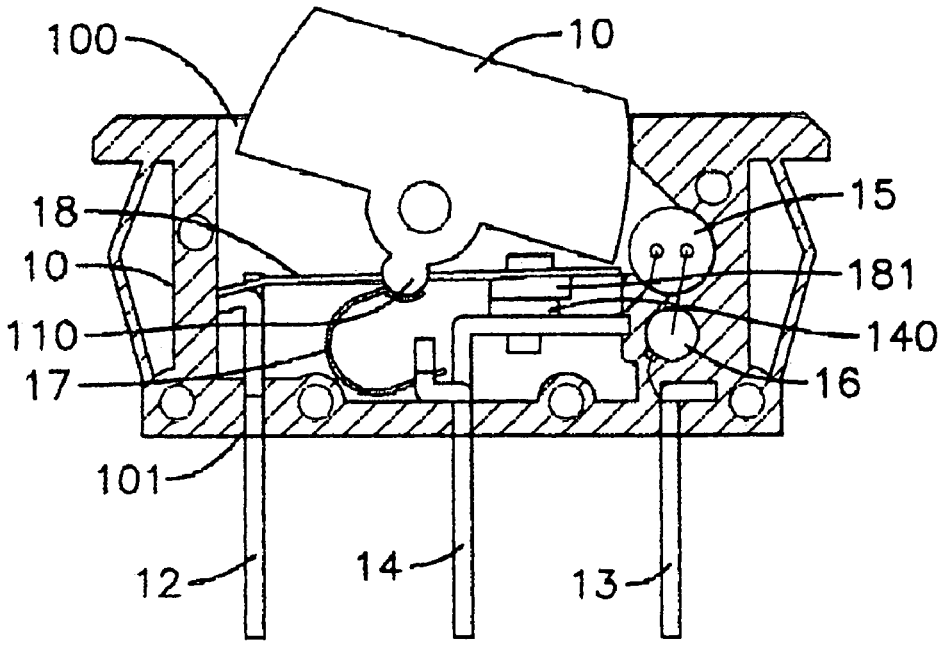
FIG. 7 is a cross sectional view showing the use of the second embodiment of the present invention.

Referring to FIGS. 6 and 7, the second embodiment of the present invention is illustrated. The difference of the second embodiment from the first embodiment is that one end of the metal sheet 18 connected to the first power terminal 12 has no U shape structure. The conductive silver sheet 181 is directly installed on the metal sheet 18 at a position corresponding to that of the electric silver sheet 140. If the current overloads, the connection of the metal sheet 18 and the first power terminal 12 will deform so that the metal sheet 18 curls upwards to drive the button 11 to eject upwards. Thereby by the action of the elastomer 17 and the press block 110, the same effect of the first embodiment is achieved.

Figure 8:
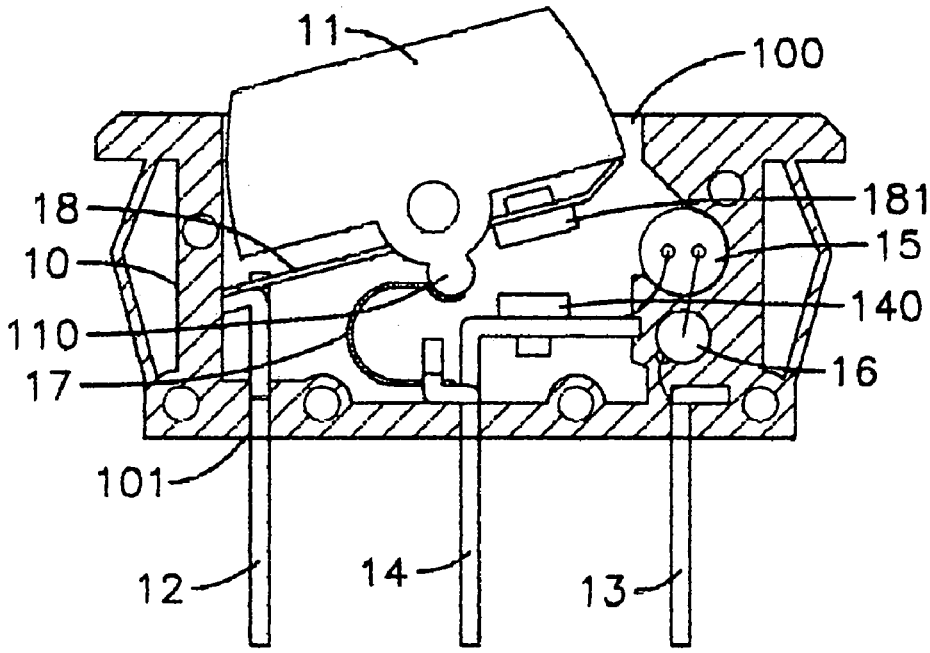
FIG. 8 is a cross sectional view about the third embodiment of the present invention.
Figure 9:
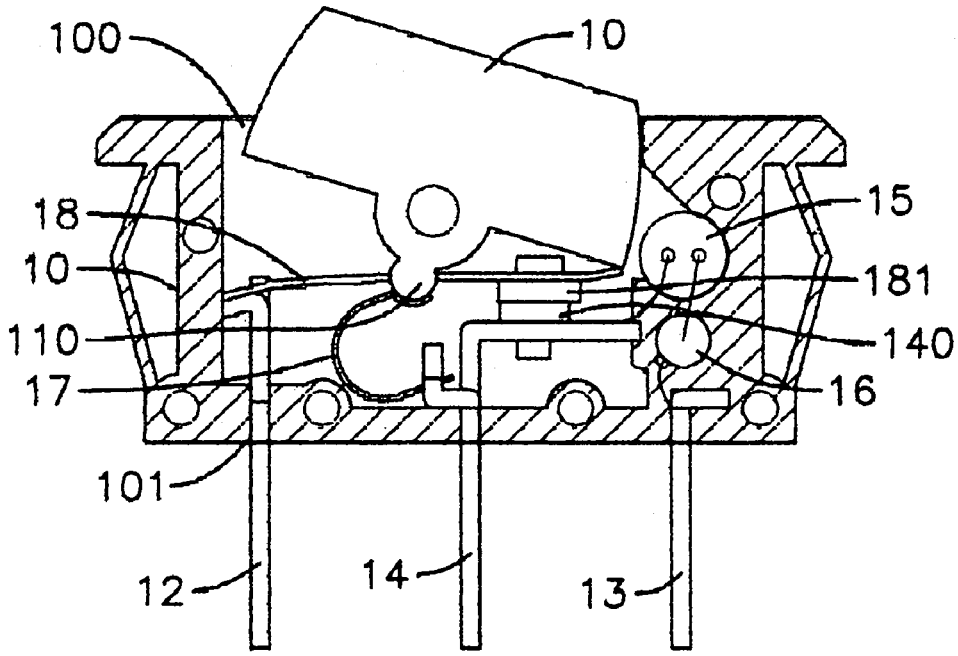
FIG. 9 is a cross sectional view showing the use of the third embodiment of the present invention.

Referring to FIGS. 8 and 9, the second embodiment of the present invention is illustrated. The difference of the third embodiment from the second embodiment is that one end of the metal sheet 18 has the conductive silver sheet 181 which is bent toward the button so as to increase the elastic force as over current occurs in the metal sheet 18.

The present invention has a simple structure and is made a fewer elements. Thereby the manufacturing process is simplified. The fault rate of the safety switch of the present invention is reduced.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A safety switch comprising:

a hollow body having an opening at an upper end thereof and a lower end of the hollow body having three slots which are spaced arranged;

a button pivotally installed upon the opening of the hollow body; a press-block downwards extending from a pivotal point of the button;

a first power terminal installed at one of the three slots;

a second power terminal installed at another of the three slots;

a load terminal installed at the other slot of the three slots which is located between the first power terminal and the second power terminal; the load terminal being electrically connected to the second power terminal; an upper side of the load terminal being installed with an electric silver sheet;

an elastomer being a U shape metal piece; one end of the elastomer being buckled to an upper end of the load terminal and another end thereof being buckled to the press block of the button; and a metal sheet being installed at a lower side of the button; the metal sheet being made of a compound metal having materials of different expansion coefficients; one end of the metal sheet being connected to an upper end of a power terminal; another end thereof being installed with a conductive silver sheet corresponding to the electric silver sheet of the load terminal.

2. The safety switch as claimed in claim 1, wherein the metal sheet connected to the first power terminal has a U shape structure and the conductive silver sheet is installed at a lower side of the U shape structure.

3. The safety switch as claimed in claim 2, wherein a neon bulb and a resistor is installed between the load terminal and the second power terminal.

4. The safety switch as claimed in claim 1, wherein the metal sheet connected to the first power terminal and installed with the conductive silver sheet is bent toward the button.

5. The safety switch as claimed in claim 1, wherein a neon bulb and a resistor is installed between the load terminal and the second power terminal.

6. The safety switch as claimed in claim 1, wherein a neon bulb and a resistor is installed between the load terminal and the second power terminal.

* * * * *